US007534123B2

(12) United States Patent
Koga

(10) Patent No.: US 7,534,123 B2
(45) Date of Patent: May 19, 2009

(54) MOVABLE CONNECTOR

(75) Inventor: Masahiro Koga, Kanagawa (JP)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/540,812

(22) PCT Filed: Dec. 26, 2003

(86) PCT No.: PCT/JP03/16920

§ 371 (c)(1),
(2), (4) Date: Jan. 6, 2006

(87) PCT Pub. No.: WO2004/059802

PCT Pub. Date: Jul. 15, 2004

(65) Prior Publication Data

US 2006/0128198 A1 Jun. 15, 2006

(30) Foreign Application Priority Data

Dec. 26, 2002 (JP) ..... 2002-378467

(51) Int. Cl.
*H01R 13/64* (2006.01)

(52) U.S. Cl. ..... 439/248

(58) Field of Classification Search ..... 439/247–248, 439/700, 824

See application file for complete search history.

(56) References Cited

U.S. PATENT DOCUMENTS 5,306,168 A * 4/1994 Kunishi et al. ..... 439/248
5,306,169 A * 4/1994 Fukushima et al. ..... 439/248
6,347,950 B1 * 2/2002 Yokoyama et al. ..... 439/248

FOREIGN PATENT DOCUMENTS

JP 4-370677 A 12/1992
JP 6-60953 3/1994
JP 2527144 2/1997
JP 2002-93502 A 3/2002

* cited by examiner

*Primary Examiner*—Felix O Figueroa
(74) *Attorney, Agent, or Firm*—Harrington & Smith, PC

(57) ABSTRACT

A connector, being a connector where one portion of the housing protrudes, and where an electrical connection and mechanical fixation is achieved by the protruding portion being housed within a recessed portion of an opposing connector. The housing has a fixing portion for fixing to a board and a movable protruding portion. The protruding portion is supported by the fixing portion of the housing via contact portions. The protruding portion has stoppers for stopping the protruding portion by coming into contact with the contact portions when inserting the connector. The contact portions have stoppers for stopping the protruding portion by coming into contact with the housing when removing the connector.

12 Claims, 5 Drawing Sheets

MOVABLE CONNECTOR

TECHNICAL AREA

The present invention concerns an electrical connector, and particularly concerns a connector having a movable portion. Further, the connector of the present invention has, within the housing, a stopper that stops the movable portion.

BACKGROUND ART

Normally, electrical connections are formed using electrical connectors by joining a male type and a female type connector. However, when joining connectors in a narrow space, for example, within the body of a personal computer or imaging equipment, there are cases where sufficient workspace cannot be secured, thereby making connecting difficult. The cause for this is that when inserting or unplugging a connector, the male and female connectors must be accurately positioned, and they must be moved in a direction parallel to the inserting and removing direction, but in the case of narrow spaces as described above, accurate positioning and parallel movement can be difficult.

Normally, in such cases, a movable portion is provided on a connector in order to make positioning of the connector easy.

As shown in FIG. 1, a conventional connector 1 has a protruding portion 2 and a fixing portion 3 for fixing to a board, and this protruding portion 2 becomes a movable portion, making the above-mentioned positioning and the like easier.

However, in this case, a member for restricting the movement of said protruding portion is needed in order to stabilize the protruding portion 2 during insertion and removal of the connector. Therefore, concerning the production of connectors, there were problems, such as the product lifetime being affected, and production costs increasing because of the increase in the number of parts.

In consideration of the above problems, the present invention provides a connector with a stopper provided as a restricting member on a protruding portion of the housing, and specifically, by providing a connector characterized by being a connector whereof a portion of the housing protrudes, and wherefor an electrical connection and mechanical fixation is achieved by said protruding portion being housed within a recessed portion of an opposing connector, the housing having a fixing portion fixed to a board, and a movable said protruding portion, said protruding portion being supported by the fixing portion of the housing via a contact portion, and said protruding portion having a stopper that comes into contact with the contact portion thereby stopping said protruding portion when the connector is inserted, the movement of said protruding portion can be stopped and joining can be ensured when the connector is inserted.

Additionally, a connector is provided that is characterized in similarly being a connector whereof a portion of the housing protrudes, and wherefor an electrical connection and mechanical fixation is achieved by said protruding portion being housed within a recessed portion of an opposing connector, the housing having a fixing portion fixed to a board and a movable said protruding portion, said protruding portion being supported by the fixing portion of the housing via the contact portion, said contact portion having a stopper that comes into contact with the housing thereby stopping said protruding portion when the connector is removed. Whereby, the operation of the protruding portion (20) or the connector can be made smooth when the connector is removed.

Further, a connector is provided characterized in that, in these connectors having a stopper, the contact portions are exposed on one surface or both surfaces of the protruding portion, and have touching portions that electrically connect to an opposing connector.

Regarding the positions of the contacts, by providing a connector characterized in that the contact portions are aligned in a zigzag form, a movable connector can be provided that has more contacts.

The present invention further provides a connector characterized in that both stoppers described above are formed in the same housing, restricting the movement of the protruding portion in both the insertion and removal directions of the connector. Whereby, a movable connector effective for both the insertion and removal directions can be provided.

BRIEF EXPLANATIONS OF THE DRAWINGS

BEST MODES FOR EMBODYING THE INVENTION

Herebelow, details of the present invention shall be explained using drawings.

Figure 2:
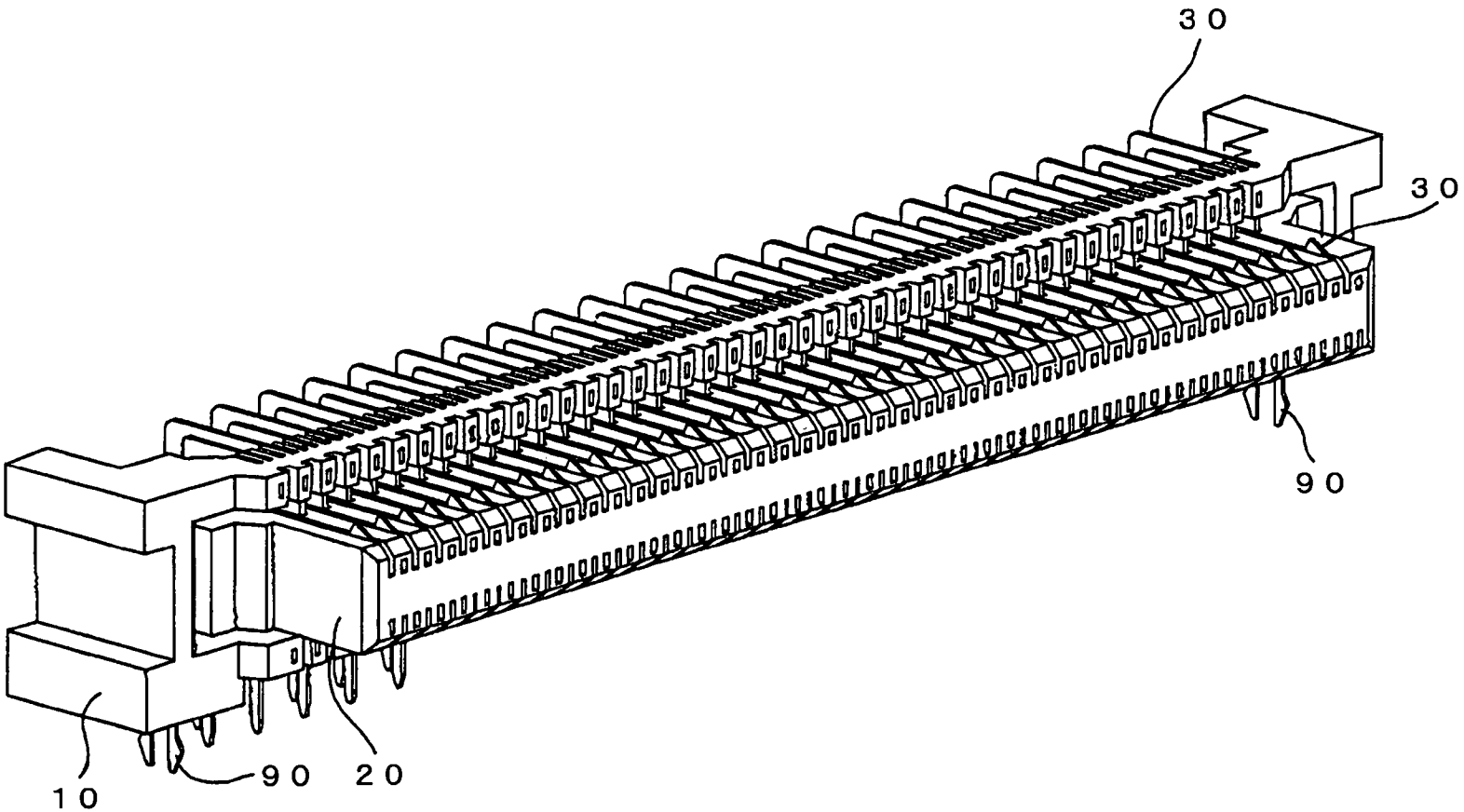
FIG. 2 is a perspective view of the entirety of the connector of the present invention.

FIG. 2 is a perspective view showing the entirety of the connector of the present invention. As shown in the diagram, there are a housing (10) fixed to a board (herebelow called a fixing portion), and a protruding portion (20) that fits into a recessed portion of an opposing connector. Said protruding portion (20) is supported by the fixing portion (10) via contacts (30), but the position and angle of the protruding portion (20) relative to the fixing portion (10) can be changed slightly. That is, the protruding portion (20) is supported movably relative to the fixing portion due to the elastic deformation of the contacts (30). Further, the fixing portion (10) is fixed to the board by fixing members (90). The protruding portion (20) is aligned parallel relative to the board, and is of the so-called right angle type.

Figure 1:
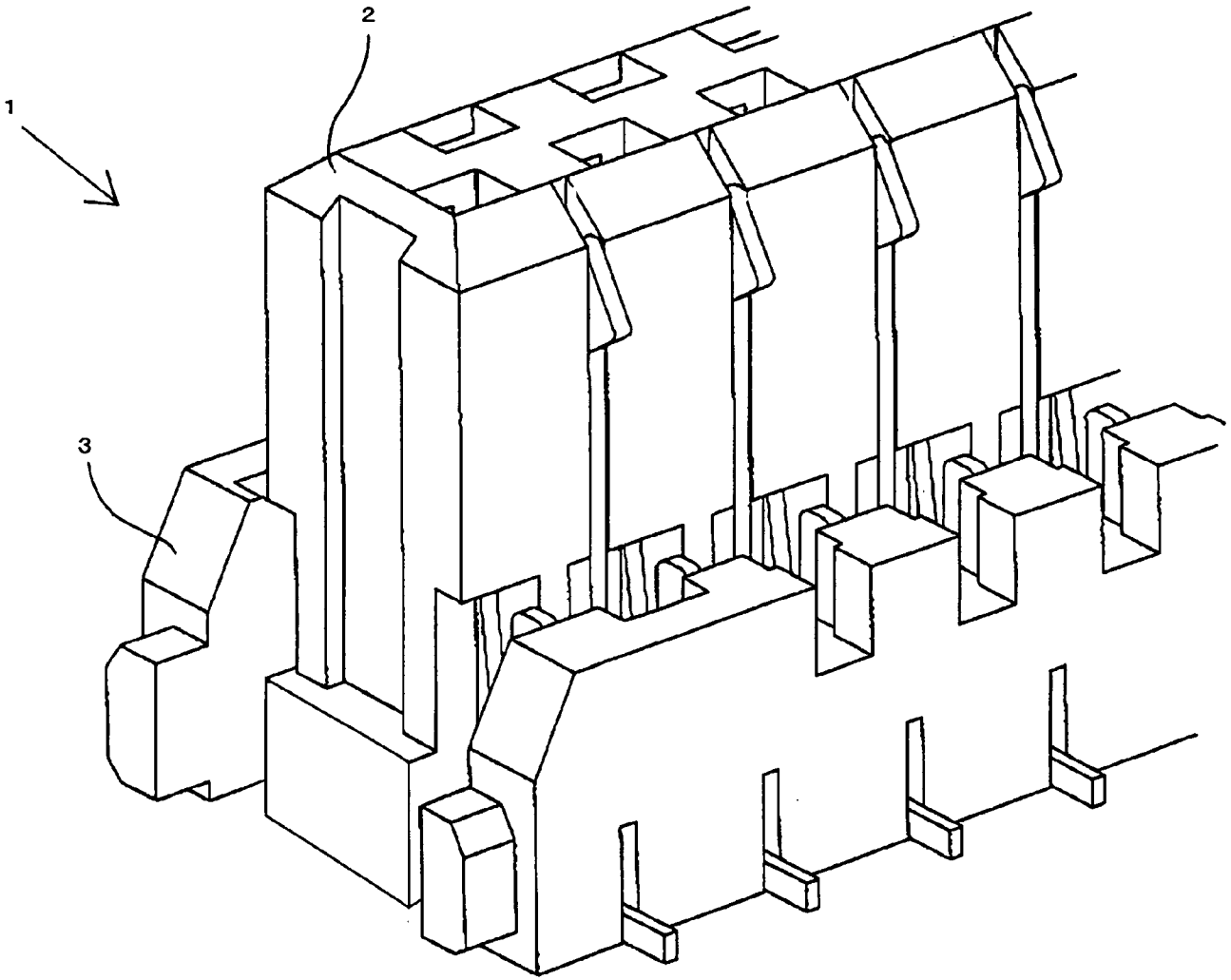
FIG. 1 is a movable connector of the conventional art.
Figure 3:
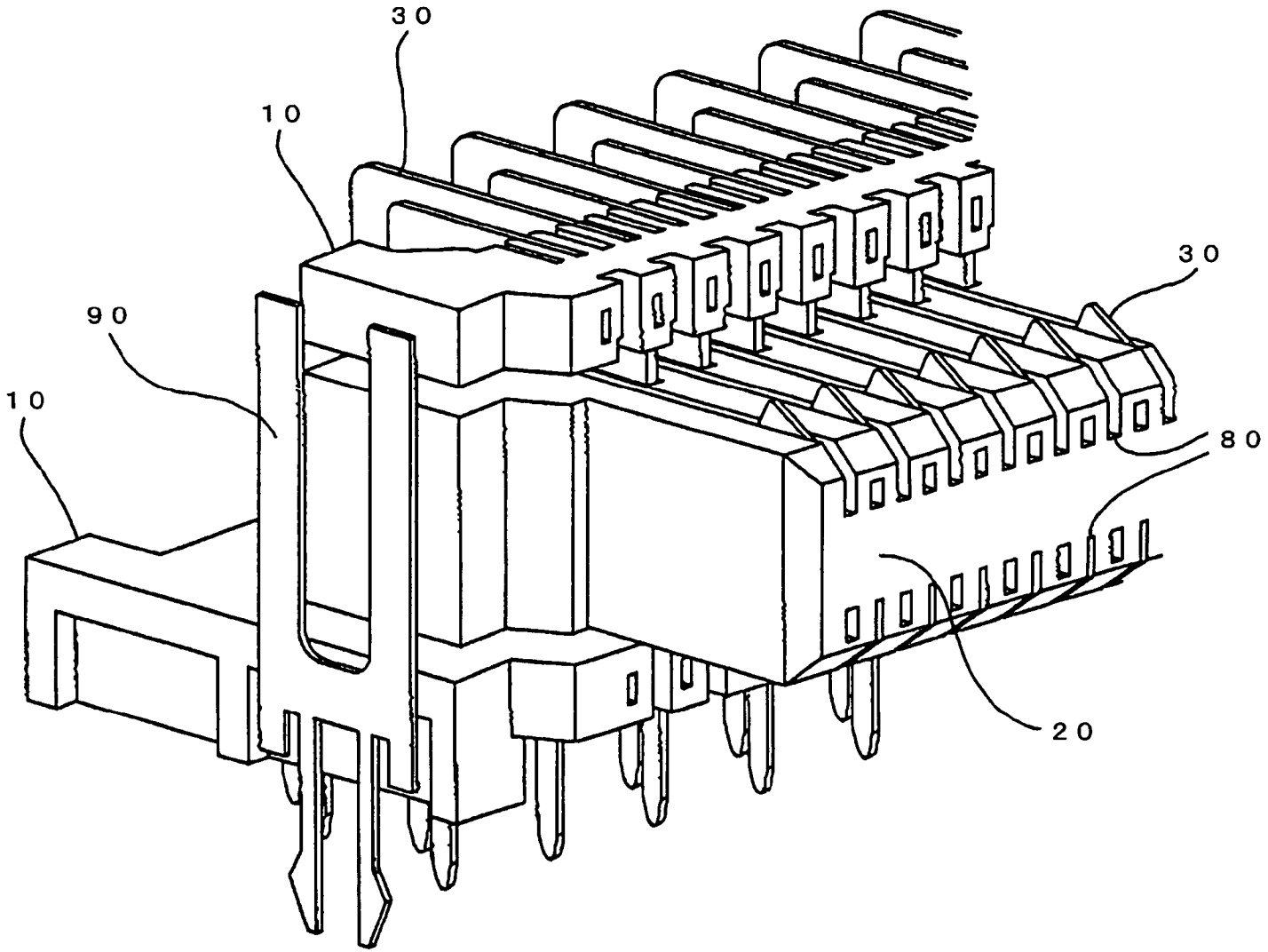
FIG. 3 is a perspective view of the vicinity of the fixing member of the connector of the present invention.

The relationship between the protruding portion (20) and the fixing portion (10) of the connector of the present invention is shown in FIG. 3. FIG. 3 is a perspective view of the vicinity of a fixing member (90) of the connector of FIG. 1, and as shown in the diagram, the fixing members (90) are housed within the fixing portion (10), and located on both sides of the protruding portion (20) (only one side is depicted in the diagram). Thereby, the fixing portion (10) is fixed to a board, and additionally, it can be fixed so it does not interfere with the protruding portion (20).

Herebelow, the stopper for restricting the protruding portion of a connector of the present invention shall be explained in detail.

Figure 4:
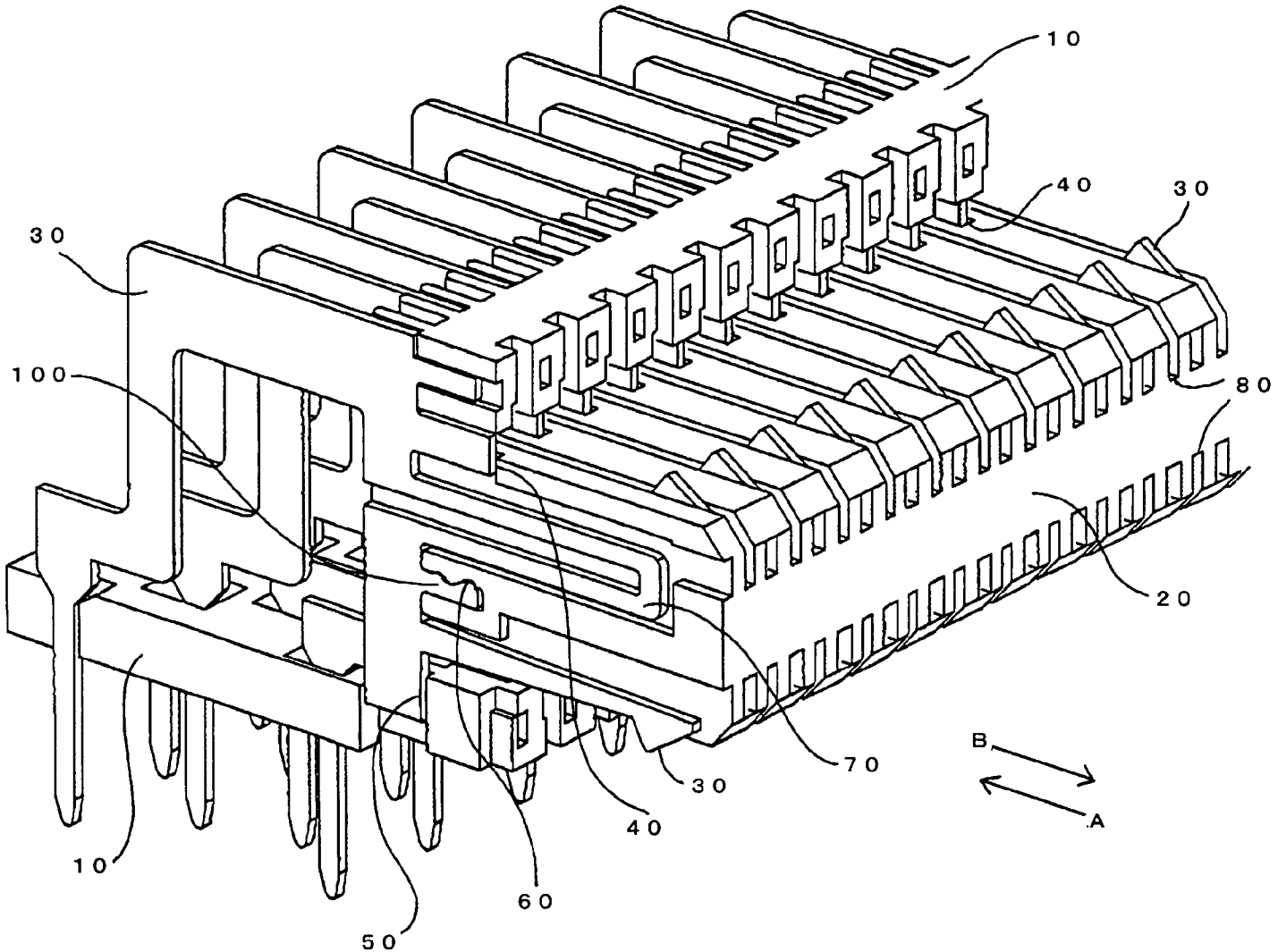
FIG. 4 is a perspective view containing a cross-section of the connector of the present invention.
Figure 5:
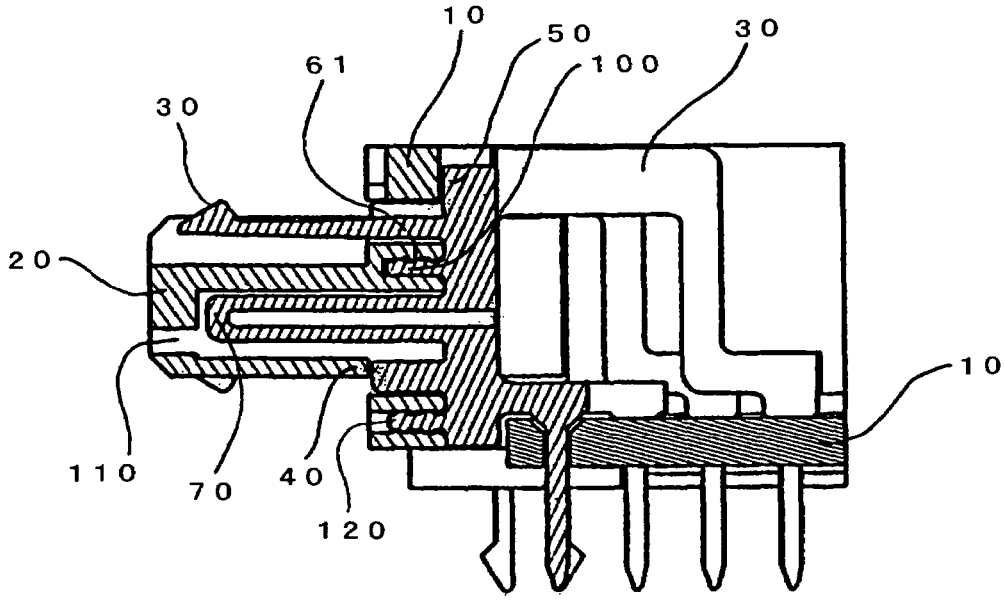
FIG. 5 is a cross-section of the connector of the present invention.

Said stopper is shown in FIG. 4 and FIG. 5, FIG. 4 being a perspective view including a cross-section parallel to the insertion and removal direction of the stopper of the present invention, and FIG. 5 being a cross section. Arrows A and B in FIG. 4 respectively show the direction in which the protruding portion receives a force from a female type connector during connection of the connector, and the direction in which the protruding portion receives a force from a female type connector during removal of the connector. Here, according to one embodiment of the invention, the contacts (30) are aligned in a zigzag manner. Therefore, since there are contacts that are exposed on one surface of the protruding portion, and there are contacts exposed on the other surface of the protruding portion, the alignment of the stoppers differs for the two sides of the protruding portion (20). The contacts (30) shown in the cross-section shown in FIG. 4 are an example of contacts exposed on the board side, and the cross-section shown in FIG. 5 show contacts exposed on the surface of the opposite side from the board.

The stoppers that stop the protruding portion when the connector is inserted, being a constituent feature of the present invention, is indicated by the reference number (40) in FIG. 4 and FIG. 5. Said stoppers shall herebelow be referred to as protruding portion stoppers (40). Additionally, one portion of the contacts (30) are housed within the protruding portion (20), as shown in FIG. 4 and FIG. 5, and generate elastic force particularly due to an elastic force portion bent in a "U" shape (70). Additionally, said protruding portion (20) is fixed by engaging the contacts (30), and said engaging portion is indicated by reference number (60). In said engaging portion (60), the portions of the contacts and the protruding portion that engage each other are respectively formed in a concave and a convex shape, and due to the concavity and the convexity mutually interlocking, the protruding portion (20) and the contacts (30) are fixed. Further, the contacts (30) have a portion that protrudes in order to be fixed to a fixing portion (10). As shown in FIG. 5, this is fixed by a member indicated by reference number (120).

Next, the operation of the protruding portion during the insertion and removal of the connector shall be explained. In FIG. 4, when inserting a connector, the connector is moved in the direction indicated by Arrow B. At this time, the said protruding portion (20) or contacts (30) are pressed due to friction with the opposing female type connector, and move in the direction indicated by Arrow A. That is, they are "pushed into" the housing.

On the other hand, during connector removal, said connector is pulled out from the opposing female type connector in the direction indicated by Arrow A, and at this time, the protruding portion (20) or the contacts (30) are moved in the direction indicated by Arrow B due to friction with said female type connector, that is, the contacts (30) are "pulled" by the fixing portion (10).

In this insertion and removal operation, first, during connector insertion, if said protruding portion (20) is "pushed in" as mentioned above and moved a certain distance, the said protruding portion stoppers (40) will come into contact with contacts that are behind them. At this time, the protruding portion (20) cannot move any further, and stops. After this, if the connector is further inserted, since the protruding portion (20) cannot move due to said stoppers (40), it connects to the opposing female type connector along with the fixing portion (10) and the contacts (30).

Next, when the connector is removed, the contacts (30) are "pulled" due to the fixing portion (10). At this time the protruding portion (20) is housed within the opposing female type connector, but said connector is substantially fixed by the frictional force between the contacts (30) and the contacts of the opposing said female type connector. The fixing portion (10) moves in the direction indicated by Arrow A, but the protruding portion (20) remains in a state housed within the female type connector, that is, it moves in the direction indicated by Arrow B relative to the fixing portion (10). In other words, during connector removal, since the elastic force portion (70) absorbs the "pulling force" of the "pull" of the fixing portion (10), removal is done with the protruding portion (20) left within the female type connector.

After this, when the fixing portion (10) moves a certain distance, the stoppers (50) of the contact portion (herebelow called the contact portion stoppers (50)), come into contact with the fixing portion (10). Therefore, the protruding portion (20) or the contacts (30) can resist the removing force of the connector due to the contact portion stoppers (50), and therefore the protruding portion (20) or the contacts (30) are removed from the female type connector along with the fixing portion (10).

The operation of the protruding portion and the function of each of the stoppers during insertion and removal of the connector have been shown. Here, those skilled in the art can understand this, but the protruding portion (20) is supported by the fixing portion (10) via the contacts (30), and these engage each other through the engaging portion (60) provided on the contacts and the protruding portion, as mentioned above.

In the case of a connector based upon a certain embodiment of the present invention, wherein the contacts are exposed on both surfaces of the protruding portion, as indicated by reference number (80) in FIG. 4, the contacts are placed in a zigzag manner. At this time, two types of shapes of contacts become necessary. That is, among the contacts that are exposed on both surfaces of the protruding portion, a contact wherefor the point of contact with a contact of the female type connector is exposed on the surface of the board side of the protruding portion is the contact shown in the cross-section shown in FIG. 4 (the contacts shown as closest to the viewer in the figure), and from the bottom to the top of the figure, the portion that touches a contact of the female type connector, the engaging portion (60), the elastic force portion (70), and the portion that touches a protruding portion stopper (40) are shown. On the other hand, the contacts wherein the points of contact with the contacts of the female type connector are exposed on the opposite side from the board of the protruding portion, have a structure as shown in FIG. 5, and seen from the board side of the contacts (that is, from the bottom to the top of the figure), the portion that touches a protruding portion stopper (40), the elastic force portion (70), the engaging portion (60), and the portion that touches the contacts of the female type connector are shown. However, the present invention is not restricted to these.

For example, as shown in FIG. 5, the portion touching the protruding portion stopper (40) is a portion of a contact, but it could be made into said touching portion by extending the fixing portion (10) and forming it into an appropriate shape.

Figure 6:
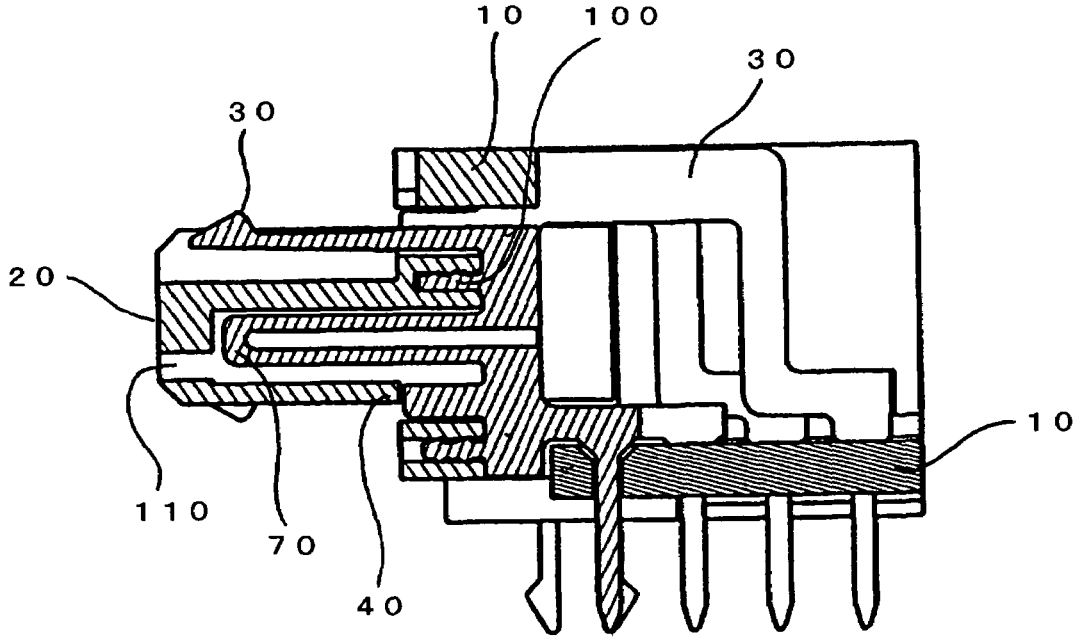
FIG. 6 is a diagram showing another embodiment of the connector of the present invention.

Next, another embodiment of the present invention shall be explained using FIG. 6.

FIG. 6 is a structure only having protruding portion stoppers (40). In this case, said stoppers (40) realize their effects during the insertion of the connectors. Additionally, although not shown in a figure, an embodiment having only contact portion stoppers is also possible. However, it is obvious that having stoppers on both the protruding portion and the contact portion is more effective. As mentioned above, in the present invention, by focusing primarily on the shape of the contacts, and making improvements on this shape, a stopper function was able to be secured by making them touch the housing portion.

INDUSTRIAL APPLICABILITY

As mentioned above, the present invention, by providing stoppers against both the insertion and removal direction in the housing for a movable connector, a movable connector can be utilized without having to provide a separate stopper.

The invention claimed is:

1. A connector comprising a housing including a fixing portion adapted to be fixed to a board and a movable protruding portion adapted to be housed within a recessed portion of an opposing connector, said fixing portion and said protruding portion being separate from each other, and said protruding portion being supported by the housing fixing portion via contact portions;

wherein said protruding portion comprises first stoppers adapted to come into contact with the contact portions thereby stopping said protruding portion when the connector is inserted in the opposing connector; and wherein said contact portions comprise second stoppers adapted to move toward the fixing portion and come into contact with the fixing portion when the fixing portion is moved in a direction away from the opposing connector thereby stopping said protruding portion when the connector is removed from the opposing connector, and wherein the connector comprises a gap between the second stoppers and the fixing portion to allow movement therebetween.

2. A connector recited in claim 1 wherein the contact portions are exposed on one surface or both surfaces of the protruding portion, and have touching portions which are adapted to electrically connect to the opposing connectors.

3. A connector recited in claim 1 wherein the contact portions are aligned in a zigzag manner.

4. A connector recited in claim 1 wherein the first stoppers are formed in the housing, and restrict the movement of the protruding portion in both insertion and removal directions of the connector.

5. A connector comprising:

a housing comprising a fixing portion and a movable protruding portion, wherein the fixing portion is adapted to be fixed to a board, wherein the movable protruding portion is adapted to be housed within a recessed portion of an opposing connector, wherein the fixing portion and the protruding portion are separate from each other, wherein the protruding portion is supported on the housing fixing portion by contact portions;

wherein the protruding portion comprises first stoppers adapted to contact the contact portions to stop the protruding portion when the connector is inserted in the opposing connector; and wherein the contact portions comprise second stoppers, wherein the second stoppers are spaced from sections of the fixing portion when the connector is inserted in the opposing connector, wherein the second stoppers are adapted to contact the sections of the fixing portion when the fixing portion is moved in a direction away from the opposing connector to stop the protruding portion when the connector is removed from the opposing connector, and wherein the connector comprises a gap between the second stoppers and the fixing portion to allow movement therebetween.

6. A connector recited in claim 5 wherein the contact portions are exposed on one surface or both surfaces of the protruding portion, and have touching portions which are adapted to electrically connect to the opposing connector.

7. A connector recited in claim 5 wherein the contact portions are aligned in a zigzag manner.

8. A connector recited in claim 5 wherein the first stoppers are formed in the housing, and restrict the movement of the protruding portion in both insertion and removal directions of the connector.

9. A connector, whereof a portion of a housing protrudes, and wherefor an electrical connection and mechanical fixation is achieved by said protruding portion being housed within a recessed portion of an opposing connector, characterized by:

the housing having a fixing portion fixed to a board, wherein said protruding portion is movable, and wherein the fixing portion and the protruding portion are separate from each other;

said protruding portion being supported by the housing fixing portion via contact portions;

said protruding portion having first stoppers that come into contact with the contact portions thereby stopping said protruding portion when the connector is inserted in the opposing connector; and said contact portions having second stoppers, wherein the contact portions are movable at the second stoppers relative to the fixing portion, wherein the second stoppers come into contact with the fixing portion when the fixing portion is moved in a direction away from the opposing connector thereby stopping said protruding portion when the connector is removed from the opposing connector, and wherein the connector comprises a gap between the second stoppers and the fixing portion to allow movement therebetween.

10. A connector recited in claim 9, characterized in that the contact portions are exposed on one surface or both surfaces of the protruding portion, and have touching portions that electrically connect to an opposing connector.

11. A connector recited in claim 9, characterized in that the contact portions are aligned in a zigzag manner.

12. A connector recited in claim 10, characterized in that the first stoppers are formed in the housing, restricting the movement of the protruding portion in both the insertion and removal directions of the connector.

* * * * *